US007922017B2

(12) United States Patent
Shingle et al.

(10) Patent No.: US 7,922,017 B2
(45) Date of Patent: Apr. 12, 2011

(54) CHILD-RESISTANT CLOSURE, CONTAINER AND PACKAGE CONVERTIBLE TO NON-CHILD-RESISTANT OPERATION

(75) Inventors: John M. Shingle, Perrysburg, OH (US); Maurice R. Gnepper, Fremont, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 1735 days.

(21) Appl. No.: 11/129,194

(22) Filed: May 12, 2005

(65) Prior Publication Data

US 2006/0255004 A1 Nov. 16, 2006

(51) Int. Cl.
*B65D 41/06* (2006.01)
*B65D 55/02* (2006.01)
*B65D 53/00* (2006.01)

(52) U.S. Cl. ..... 215/332; 215/218; 215/344; 215/252; 215/DIG. 1

(58) Field of Classification Search ..... 215/341–344, 215/332, 43, 44, 218, 354, DIG. 1, 252, 217, 215/254, 256
See application file for complete search history.

(56) References Cited

U.S. PATENT DOCUMENTS

| | | | | |
|---|---|---|---|---|
| 3,568,871 | A * | 3/1971 | Livingstone | 215/344 |
| 3,596,694 | A * | 8/1971 | Jaeniche | 220/789 |
| 4,128,184 | A | 12/1978 | Northup | |
| 4,322,012 | A * | 3/1982 | Conti | 215/344 |
| 4,485,932 | A | 12/1984 | Kusz | |
| 4,526,284 | A | 7/1985 | Herbert | |
| 4,567,992 | A | 2/1986 | Davis | |
| 4,645,088 | A | 2/1987 | Menichetti | |
| 4,752,013 | A | 6/1988 | Miler et al. | |
| 5,161,707 | A * | 11/1992 | Dutt et al. | 215/344 |
| 5,449,078 | A | 9/1995 | Akers | |
| 5,609,263 | A | 3/1997 | Perchepied | |
| 5,630,522 | A * | 5/1997 | Montgomery | 215/344 |
| 6,016,930 | A | 1/2000 | Mathes et al. | |
| 6,341,707 | B1 * | 1/2002 | Witt et al. | 215/256 |
| 6,378,713 | B2 * | 4/2002 | Montgomery | 215/222 |
| 6,382,445 | B1 | 5/2002 | McCandless | |

(Continued)

FOREIGN PATENT DOCUMENTS

DE 4217539 12/1993

(Continued)

*Primary Examiner* — Robin Hylton
(74) *Attorney, Agent, or Firm* — Reising Ethington PC

(57) ABSTRACT

A child-resistant package includes a container having an open mouth, a conical external surface around the open mouth that widens away from the mouth and a wall extending from the conical external surface. A closure has a base wall, and a peripheral skirt having a first portion adjacent to the base wall and a second portion removably connected to the first portion. An annular first wall extends from the base wall at a position radially inward from the skirt for spring/sealing engagement with the conical external surface of the container. A second wall extends from the base wall at a position radially inward from the first wall and, preferably, at an outward conical angle to the base wall. The second portion of the skirt and the wall on the container have interlocking elements that resist removal of the closure from the container in a child-resistant mode of operation absent a force against the first wall to disengage the interlocking elements. The second portion of the skirt is frangibly removable from the first portion to remove the interlocking elements from the skirt so that the closure is securable to the container in a non-child-resistant mode of operation with the second wall received by snap-fit within the container mouth.

19 Claims, 3 Drawing Sheets

U.S. PATENT DOCUMENTS

| | | | |
|---|---|---|---|
| 6,446,823 | B2 | 9/2002 | Miceli et al. |
| 6,450,352 | B1 | 9/2002 | DeJonge |
| 6,612,450 | B1 | 9/2003 | Buono |
| 6,640,987 | B2 | 11/2003 | Vassallo |
| D489,005 | S | 4/2004 | Miceli et al. |
| D489,610 | S | 5/2004 | Miceli et al. |
| 2003/0075519 | A1 | 4/2003 | Miceli et al. |
| 2004/0007556 | A1 | 1/2004 | Manera et al. |
| 2004/0173562 | A1 | 9/2004 | Wolfe |
| 2005/0103741 | A1 | 5/2005 | Shingle |
| 2007/0023380 | A1 | 2/2007 | Shingle |

FOREIGN PATENT DOCUMENTS

| | | |
|---|---|---|
| WO | WO 2005/035380 | 4/2005 |

* cited by examiner

CHILD-RESISTANT CLOSURE, CONTAINER AND PACKAGE CONVERTIBLE TO NON-CHILD-RESISTANT OPERATION

The present disclosure relates to a child-resistant package that is convertible to non-child-resistant operation, and to a closure and a container for such a package.

BACKGROUND AND SUMMARY OF THE DISCLOSURE

U.S. patent application Ser. No. 10/682,608 discloses a child-resistant package that includes a container having at least one external thread segment adjacent to the container mouth and an external deflectable locking element spaced from the container mouth. The closure has a peripheral skirt with a first portion having at least one internal thread segment for threaded engagement with the container, and a second portion frangibly connected to the first portion with a locking element for engagement with the deflectable locking element on the container. With the second portion of the closure skirt connected to the first portion, the package is adapted for child-resistant operation requiring deflection of the locking element on the container to release the closure for threaded disengagement from the container. When the second portion of the closure skirt is removed by a user, the closure may be merely threaded on to and off of the container in a non-child-resistant mode of operation. A general objective of the present disclosure is to provide a child-resistant package, closure and container that are adapted for snap-cap operation in a non-child-resistant mode.

The present disclosure embodies a number of aspects or inventions that can be implemented separately from or in combination with each other.

A child-resistant package, in accordance with a first aspect of the present disclosure, includes a container having an open mouth, a conical external surface around the open mouth that widens away from the mouth and a wall extending from the conical external surface. A closure has a base wall, and a peripheral skirt having a first portion adjacent to the base wall and a second portion removably connected to the first portion. An annular first wall extends from the base wall at a position radially inward from the skirt for spring/sealing engagement with the conical external surface of the container. A second wall extends from the base wall at a position radially inward from the first wall and, preferably, at an outward conical angle to the base wall. The second portion of the skirt and the wall on the container have interlocking elements that resist removal of the closure from the container in a child-resistant mode of operation absent a force against the first wall to disengage the interlocking elements. The second portion of the skirt is frangibly removable from the first portion to remove the interlocking elements from the skirt so that the closure is securable to the container in a non-child-resistant mode of operation with the second wall received by snap-fit within the container mouth.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
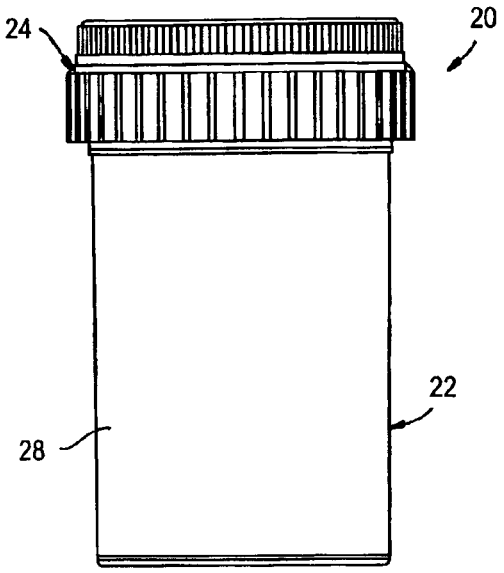
FIG. 1 is a side elevational view of a child-resistant package in accordance with an exemplary embodiment of the disclosure.
Figure 2:
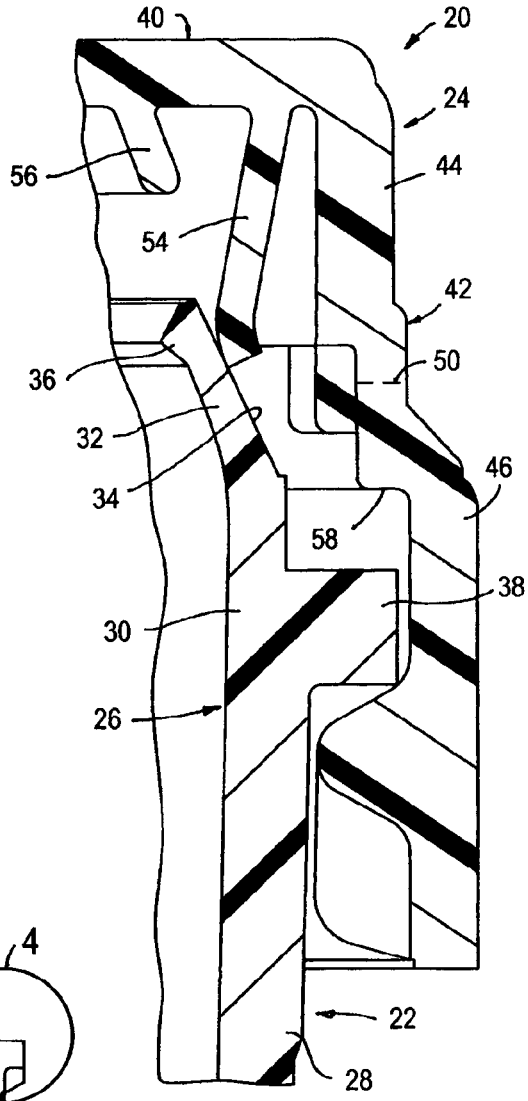
FIG. 2 is a fragmentary sectional view of the package in FIG. 1.
Figure 3:
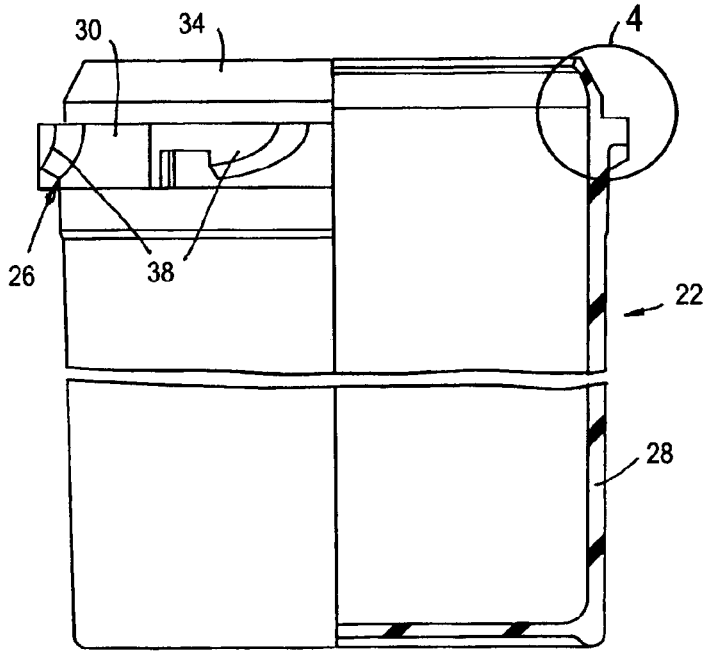
FIG. 3 is a partially sectioned elevational view of the container in the package of FIG. 1.
Figure 4:
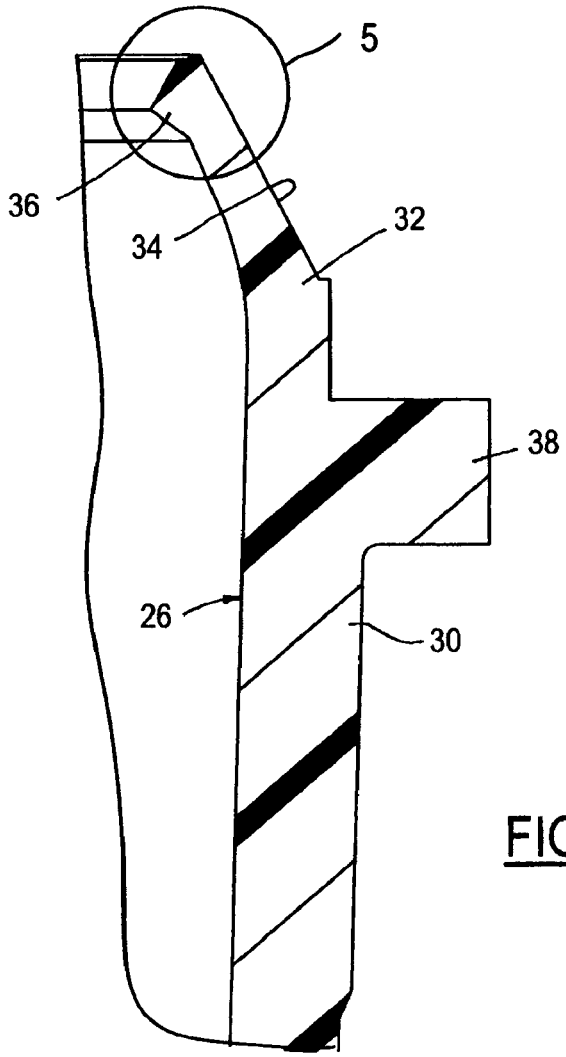
FIG. 4 is an enlarged sectional view of the portion of FIG. 3 within the area 4.
Figure 5:
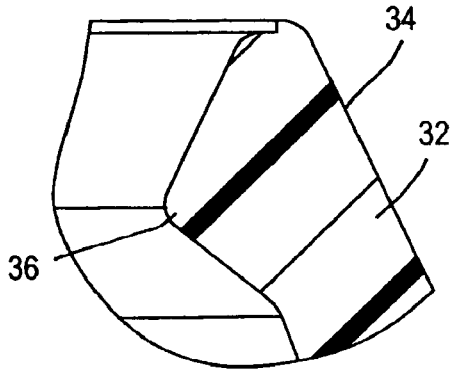
FIG. 5 is an enlarged sectional view of the portion of FIG. 4 within the area 5.

FIGS. 1-2 illustrate a package 20 in accordance with an exemplary embodiment of the present disclosure as including a container 22 and a closure 24 secured to the container in a child-resistant mode of operation. Container 22 (FIGS. 1-5) includes a generally cylindrical finish 26 that extends from a sidewall 28 of any suitable construction and geometry. Finish 26 preferably includes a cylindrical wall 30, from the upper end of which extends a radially inwardly tapering conical wall section 32. (Directional words such as "upper" and "lower" are employed by way of description and not limitation with respect to the upright orientation of the package, container and closure illustrated in the drawings. Directional words such as "radial" and "axial" are employed by way of description and not limitation with respect to the axis of the container finish and/or the closure skirt as appropriate.) Conical wall section 32 has an external conical surface 34 that widens away from the open mouth at the upper end of the container. An internal bead 36, preferably a circumferentially continuous internal bead, may extend around the inner periphery of the container mouth adjacent to the open upper end of conical wall section 32. External engagement elements 38 are disposed around the outer surface of finish wall 30 for engagement by the container closure in a child-resistant mode of operation. The specific engagement elements 38 illustrated in the drawings are similar to those illustrated in U.S. Pat. Nos. 4,059,198 and 4,485,932, although other chid-resistant engagement elements can be employed. Container 22 preferably is of one-piece integrally molded plastic construction. By way of example only, container conical surface 34 may be at a nominal angle of 25° to the axis of the container finish.

Figure 6:
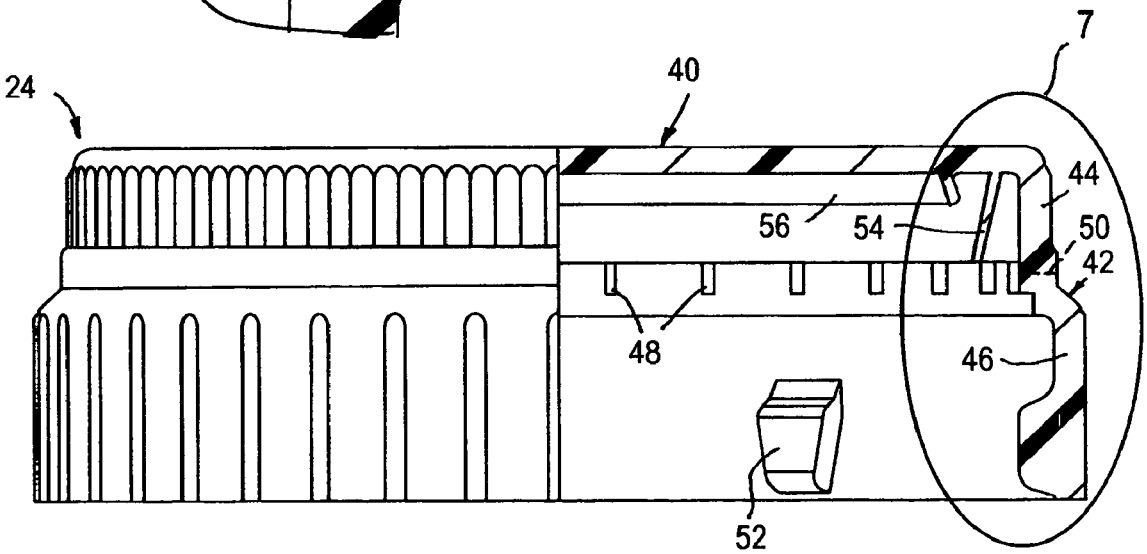
FIG. 6 is a partially sectioned elevational view of the closure in the package of FIGS. 1 and 2.
Figure 7:
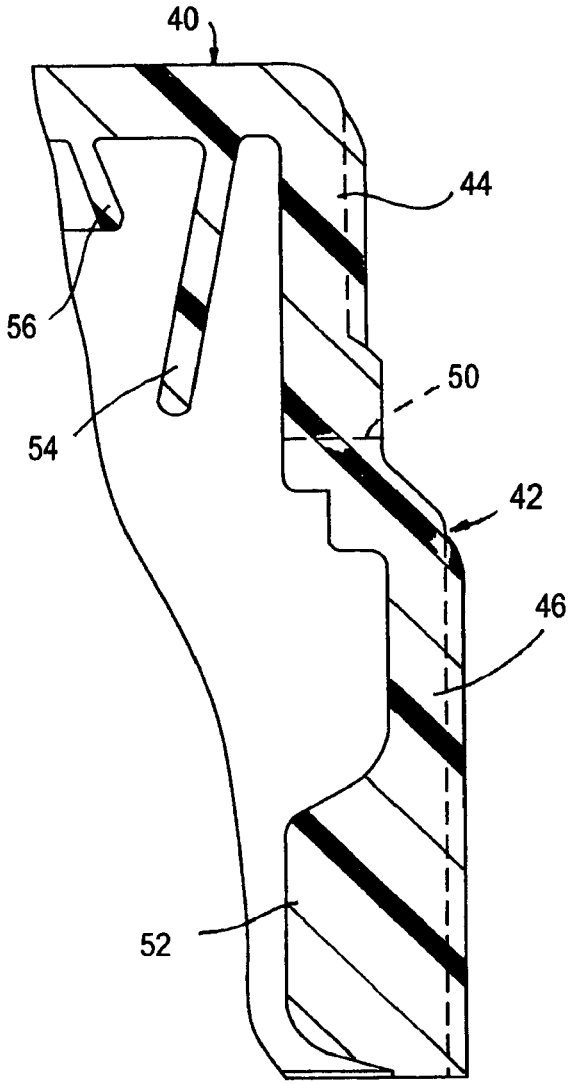
FIG. 7 is an enlarged sectional view of the portion of FIG. 6 within the area 7.

Closure 24 is of one-piece integrally molded plastic construction, and includes a base wall 40 and a peripheral skirt 42. Peripheral skirt 42 has a first or upper portion 44 adjacent to base wall 40 and a second or lower portion 46 remote from base wall 40. Second skirt portion 46 is frangibly coupled to first skirt portion 44, such as by leaders 48 that are made frangible by scoring along the line 50 (FIGS. 2, 6 and 7). Skirt portions 44, 46 alternatively can be molded as elements spaced from each other and interconnected by frangible leaders 48. Engagement elements 52 are disposed on second skirt portion 46 for engagement with elements 38 on container 22. In the specific embodiment illustrated in the drawings, engagement elements 52 are in the form of internal lugs that selectively engage pockets in container engagement elements 38.

A circumferentially continuous annular first wall 54 extends from base wall 40 within first skirt portion 44. First wall 54 is flexible and resilient, and preferably extends at a radially inward and axially downward conical angle from base wall 40 as molded. An annular second wall 56 extends from base wall 40 radially inward from first wall 54. Second wall 56 is of shorter axial dimension than wall 54, and preferably extends at an axially inward and radially outward conical angle with respect to base wall 40. (Base wall 40 is illustrated as flat in the exemplary embodiment, but can be contoured if desired.) Walls 54, 56 preferably are circumferentially continuous, concentric with each other and concentric with first skirt portion 44. Walls 54, 56 preferably are of uniform thickness, such as 0.010 inch nominal thickness for example. By way of example only, wall 54 may be at a nominal angle of 10° with respect to the axis of closure skirt 42 as molded, and wall 56 may be at a nominal angle of 20° to the closure axis as molded.

Figure 8:
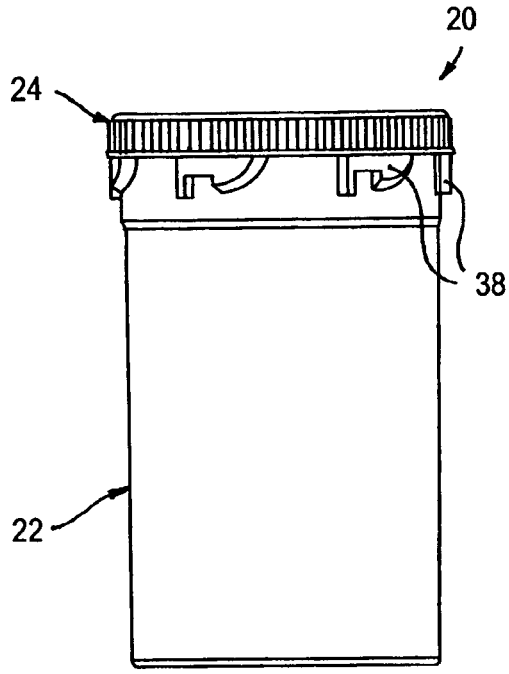
FIG. 8 is an elevational view of the package of FIG. 1 in a non-child-resistant mode of operation.
Figure 9:
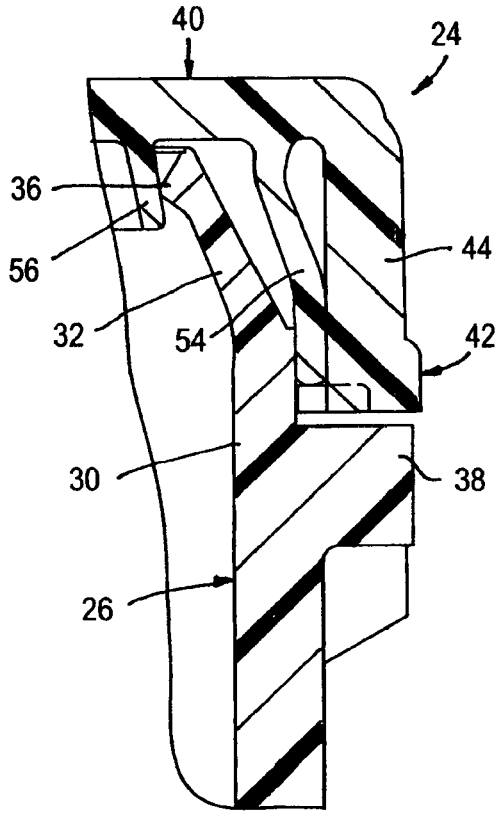
FIG. 9 is a fragmentary sectional view of the package in FIG. 8.

In a child-resistant mode of operation illustrated in FIGS. 1-2, with skirt portion 46 intact—i.e., not separated from skirt portion 44—closure first wall 54 engages external conical surface 34 of container finish 26 both to seal the package and to provide a spring force that holds interlocking elements 38,52 in engagement. Wall 54, being flexible and resilient, preferably flexes radially outwardly at the lower portion engaged with conical surface 34, while the upper portion of the first wall remains at a conically inward angle. To remove the closure from the container, force is applied manually downwardly on closure 24 with respect to container 22, against the spring force of wall 54 against surface 34, until closure engagement elements 52 clear container engagement elements 38 so that the closure can be removed from the container. An axially downwardly facing shoulder 58 on closure second skirt portion 46 cooperates with engagement elements 38 on container 22 to limit the compressive stroke that can be applied to first wall 54. For non-child-resistant operation (FIGS. 8 and 9), with the closure removed from the container, second skirt portion 46 is frangibly permanently removed from first skirt portion 44. Closure second wall 56 then is receivable by snap-fit over bead 36 within the container mouth. Closure second wall 56 preferably is circumferentially continuous, so that wall 56 seals against internal bead 36 around the container mouth. First closure wall 54 also provides a secondary seal in the non-child-resistant mode of operation. The closure thus operates as a snap-cap in the non-child-resistant mode of operation.

There thus have been disclosed a child-resistant package, closure and container that are convertible to non-child-resistant operation, and that otherwise fully satisfy all of the objects and aims previously set forth. The disclosure has been presented in conjunction with a presently preferred exemplary embodiment, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A child-resistant package that includes:

a container having an open mouth, a conical external surface around said mouth that widens away from said mouth and a wall extending from said conical external surface, and a closure having a base wall, a peripheral skirt having a first portion adjacent to said base wall and a second portion removably connected to said first portion, an annular first wall extending from said base wall at a position radially inward from said skirt for spring and sealing engagement with said conical external surface, and a second wall extending from said base wall at a position radially inward from said first wall and at an outward conical angle to said base wall, said second portion of said skirt and said wall on said container having interlocking elements that resist removal of said closure from said container in a child-resistant mode of operation absent a force against said first wall to disengage said interlocking elements, said second portion of said skirt being frangibly removable from said first portion with said closure removed from said container, to remove said interlocking elements from said skirt so that said closure is securable to said container in a non-child-resistant mode of operation with said second wall received by snap-fit within said container mouth.

2. The package set forth in claim 1 wherein said second wall on said closure is circumferentially continuous.

3. The package set forth in claim 1 wherein said container has an internal bead around said mouth for engagement by said second wall on said closure in said non-child-resistant mode of operation.

4. The package set forth in claim 1 wherein said container has a conical wall section around said mouth, said conical external surface being an external surface of said conical wall section.

5. The package set forth in claim 4 including an internal bead around said conical wall section for receiving said second wall on said closure by snap-fit in said non-child-resistant mode of operation.

6. The package set forth in claim 1 wherein said second portion of said skirt is frangibly removably connected to said first portion.

7. A child-resistant package that includes:

a container having an open mouth, a conical external surface around said mouth that widens away from said mouth and a wall extending from said conical external surface, and a closure having a base wall, a peripheral skirt extending from said base wall having a first portion adjacent to said base wall and a second portion remote from said base wall frangibly removably connected to said first portion, a flexible resilient annular first wall extending from said base wall at a position radially inward from said skirt for spring and sealing engagement with said conical external surface, and a circumferentially continuous annular second wall extending from said base wall at a position radially inward from said first wall and at an outward conical angle to said base wall, said second portion of said skirt and said wall on said container having interlocking elements for securing said closure to said container in a child-resistant mode of operation with said first wall in spring and sealing engagement with said conical external surface and said interlocking elements engaged to resist removal of said closure from said container absent a force against said first wall to disengage said interlocking elements, said second portion of said skirt being frangibly permanently removable from said first portion, with said closure removed from said container, to remove said interlocking elements from said skirt so that said closure is securable to said container in a non-child-resistant mode of operation with said second wall received by snap-fit within said container mouth.

8. The package set forth in claim 7 wherein said container has an internal bead around said mouth for engagement by said second wall on said closure in said non-child-resistant mode of operation.

9. The package set forth in claim 7 wherein said container has a conical wall section around said mouth, said conical external surface being an external surface of said conical wall section.

10. The package set forth in claim 9 including an internal bead around said conical wall section for receiving said second wall on said closure by snap-fit in said non-child-resistant mode of operation.

11. A child-resistant package that includes:

a container having an open mouth, a conical wall section surrounding said mouth and having an external surface that widens away from said mouth, and a wall extending from said conical wall section, and a closure having a base wall, a peripheral skirt extending from said base wall having a first portion adjacent to said base wall and a second portion remote from said base wall frangibly removably connected to said first portion, a flexible resilient annular first wall extending from said base wall at a position radially inward from said skirt for spring and sealing engagement with said conical external surface, and a circumferentially continuous annular second wall extending from said base wall at a position radially inward from said first wall, said second portion of said skirt and said wall on said container having interlocking elements for securing said closure to said container in a child-resistant mode of operation with said first wall in spring and sealing engagement with said conical external surface and said interlocking elements engaged to resist removal of said closure from said container absent a force against said first wall to disengage said interlocking elements, said second portion of said skirt being frangibly removable from said first portion with said closure removed from said container, to remove said interlocking elements from said skirt so that said closure is securable to said container in a non-child-resistant mode of operation with said second wall received by snap-fit within said container mouth.

12. The package set forth in claim 11 wherein said second wall extends from said base wall at an outward conical angle to said base wall.

13. The package set forth in claim 12 including an internal bead around said conical wall section for receiving said second wall by snap-fit in said non-child-resistant mode of operation.

14. The package set forth in claim 1 wherein said annular first wall provides a secondary seal in the non-child-resistant mode of operation.

15. The package set forth in claim 14 wherein said annular first wall is disposed in contact between said skirt and said container in the non-child-resistant mode of operation.

16. The package set forth in claim 7 wherein said annular first wall provides a secondary seal in the non-child-resistant mode of operation.

17. The package set forth in claim 16 wherein said annular first wall is disposed in contact between said skirt and said container in the non-child-resistant mode of operation.

18. The package set forth in claim 11 wherein said annular first wall provides a secondary seal in the non-child-resistant mode of operation.

19. The package set forth in claim 18 wherein said annular first wall is disposed in contact between said skirt and said container in the non-child-resistant mode of operation.

* * * * *